US006543881B2

(12) United States Patent
Chou

(10) Patent No.: US 6,543,881 B2
(45) Date of Patent: Apr. 8, 2003

(54) CONTROL METHOD AND STRUCTURE OF ELECTRODE DEVICE OF DIRECT ELECTROSTATIC PRINTING APPARATUS

(75) Inventor: Ching-Yu Chou, No. 16, Lane 9, Sec. 1, Chung She Rd., Taipei (TW)

(73) Assignee: Ching-Yu Chou (TW)

( * ) Notice: Subject to any disclaimer, the term of this patent is extended or adjusted under 35 U.S.C. 154(b) by 0 days.

(21) Appl. No.: 09/968,092

(22) Filed: Oct. 1, 2001

(65) Prior Publication Data

US 2002/0044172 A1 Apr. 18, 2002

(30) Foreign Application Priority Data

Oct. 12, 2000 (TW) ..... 89121366 A

(51) Int. Cl.[7] ..... B41J 2/04; B41J 2/06
(52) U.S. Cl. ..... 347/54
(58) Field of Search ..... 346/158, 159; 347/54, 55, 112, 103, 120, 127, 128, 131; 399/135, 266, 290, 271, 292, 293, 294, 295

(56) References Cited

U.S. PATENT DOCUMENTS

| | | | | |
|---|---|---|---|---|
| 3,689,935 A | | 9/1972 | Pressman et al. | 347/55 |
| 5,036,341 A | | 7/1991 | Larsson | 347/55 |
| 5,121,144 A | | 6/1992 | Larson et al. | 347/55 |
| 5,801,838 A | | 9/1998 | Larson | 347/55 |
| 5,847,733 A | * | 12/1998 | Bern | 347/55 |
| 6,059,398 A | * | 5/2000 | Desie et al. | 347/55 |
| 6,086,186 A | * | 7/2000 | Bergman et al. | 347/55 |

* cited by examiner

*Primary Examiner*—Raquel Yvette Gordon
*Assistant Examiner*—An H. Do

(57) ABSTRACT

This invention relates to a control method and structure of electrode device of a direct electrostatic printing apparatus which enables multi-leveled print depth on recording medium. By utilizing the electrode device with multiple electrode layers having at least an aperture passing through and corresponding to every print dot, as different level of print depth is needed, different voltage value is applied to the electrode device, thereby establishing a different magnitude of electric field and driving varied amounts of charged colorants passing through the aperture on the electrode device from the cartridge device and being attached onto the recording medium.

95 Claims, 11 Drawing Sheets

CONTROL METHOD AND STRUCTURE OF ELECTRODE DEVICE OF DIRECT ELECTROSTATIC PRINTING APPARATUS

FIELD OF THE INVENTION

The present invention relates to a direct electrostatic printing apparatus, and particularly relates to the control method and structure of an electrode device of the direct electrostatic printing apparatus.

BACKGROUND OF THE INVENTION

When printing or copying a high-resolution image, we often use xerography or the so-called electrophotography, which are the most common electrostatic printing methods. By means of laser or other light source devices, the desired image is transformed to light signals, and then these light signals are given to the photoreceptor, causing potential differences on the photoreceptor where the light signal is given, thereby forming latent charged pattern image. Then, the charged colorant particles driven by sufficient electric field jump out of the cartridge device and are attached onto the surface of a photoreceptor composing the desired image. Finally, the charged colorant material is transferred to papers for printing out the final image. Because the image is first formed in the photoreceptor, and then transferred to the paper, therefore, this process is called indirect printing.

Another printing method developed later is called direct electrostatic printing (DEP). The difference between DEP and Xerography is that DEP works without the aforementioned photoreceptor, but DEP uses the electrode device with multiple apertures across itself, making the desired image by means of electric signals for establishing the electric field needed in the device, and driving the charged colorant particles through the apertures and be accumulated onto paper for forming a visible image. These electric signals do not need to be transformed into another form of energy, for example, photo energy. The main idea of DEP is to simultaneously process the colorant transfer as well as the image visualization, thereby directly showing any proper image on accepted media.

When the structure and method of the current electrostatic printing apparatus is applied on an image or photograph with varied depth levels, a group of print dots is needed to represent a single image pixel. The actual number of print dots is related to the feeling of viewing colors. In other words, there are less print dots in those of lighter shade, and more print dots would make human eyes see a darker shade. This method is widely used for depth-level images or photographs. In essence, this method sacrifices print resolution for attaining the purpose of depth levels. However, this method or structure has difficulty in changing the color depth of a single print dot. As a result, the improvement of print resolution is confined.

If a single print dot can represent a single image pixel of multiple depth-level image, i.e., the depth level of each print dot is able to be changed to correspond to the depth-level image or photograph pixel in the same color depth, it is possible to improve the print quality for depth-level images without lowering the resolution.

SUMMARY OF THE INVENTION

The purpose of this invention is to provide a control methodology and structure of an electrostatic printing apparatus for every single print dot with multi-leveled print depth in order to improve the print quality under the situation of fixed machine resolution. Moreover, the control methodology of this invention can be applied further to high resolution printing with multi-leveled print depth. Additionally, this invention is not limited to black-color printing, but also can be applied independently in the printing apparatus to color-printings of yellow, cyan and magenta, etc., and therefore provides a great support for the quality improvement in full-color printing.

This invention provides a control methodology of direct electrostatic printing apparatus, including the following steps: providing an electrode device which contains n layers of electrode layer for representing (n+1) levels of print depth, and at least an aperture passing through; and while the mth level of print depth in the total of (n+1) levels of print depth is printed, applying the voltages to the total of m layers of electrode layer, thereby driving a charged colorant particle from a cartridge apparatus to pass through the aperture (s) and to be attached onto the corresponding print dot of a recording medium.

This invention also provides a control methodology of a direct electrostatic printing apparatus, including the following steps: providing an electrode device which contains n layers of electrode layer representing $2^n$ levels of print depth, and at least an aperture passing through; and while the mth level of print depth in the total $2^n$ levels of print depth is printed, applying a binary-composed voltage set to the corresponding n layers of electrode layer, thereby driving a charged colorant particle from a cartridge apparatus to pass through the aperture and to be attached onto the corresponding print dot of recording medium.

This invention also provides a control methodology of a direct electrostatic printing apparatus, including the following steps: providing an electrode device which contains n layers of electrode layer for representing k levels of print depth, where $3 \leqq k \leqq 2^n$, and at least an aperture passing through; and while the mth level of print depth in the total of k levels of print depth is printed, applying an arithmetic-composed voltage set to the corresponding n layers of electrode layer, thereby driving a charged colorant particle from a cartridge apparatus to pass through the aperture and to be attached onto the corresponding print dot of recording medium.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

This invention discloses a control methodology and a structure of an electrode device of an electrostatic printing apparatus. The apparatus provides multi-leveled print depth on recording media without reducing print resolution, and can be further applied to high-resolution printings.

Figure 1:
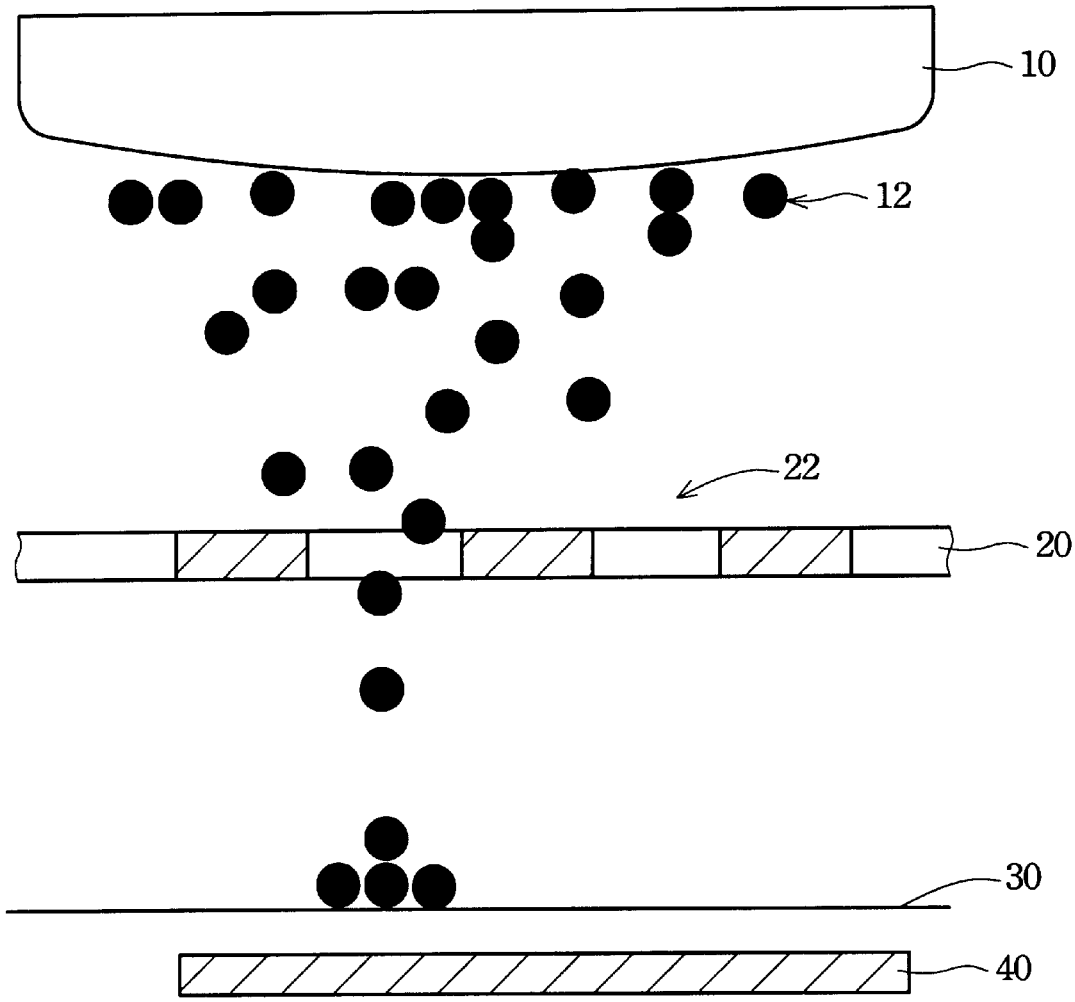
FIG. 1 is the diagram of the structure of electrostatic printing apparatus of this invention.

At first, FIG. 1 shows the diagram of the structure of the electrode printing apparatus of this invention. Similar to the traditional direct electrostatic printing apparatus (DEP), this invention includes at least a cartridge device 10, e.g., a supply roller used to supply charged colorant particle such as toners 12 or other colored particles, such as pigments or dyestuffs; an electrode device 20 containing a plurality of apertures 22 across the electrode device 20; a recording medium 30 such as paper used to store the desired image; and a back electrode device 40 working together with the electrode device 20 for attracting toners 12 onto the recording medium 30. The toners 12 from the cartridge device 10 carry a charge, such as a negative charge. Together with the electrode device 20 imposed with a counter-polarized voltage to the toners 12, such as a positive charge, the toners 12 are pulled by the electric field established by the electrode device 20, and then go through the apertures 22 in the electrode device 20. Similarly, the toners 12 are pulled again by the electric field established by back electrode device 40 on which a voltage counter-polarized to the charged toners is applied, and thus are attracted onto the recording medium 30.

Another driving method is to apply on the electrode device 20 the voltage having the same polarity as the charged toners, such as a negative charge, and on the back electrode device 40 the voltage counter-polarized to the charged toners, such as positive charge. The voltage value of the back electrode is much higher than that of the electrode device. According to the superposition characteristic of an electric field, since the back electrode device 40 produces a larger positive electric field, even with the addition of a smaller negative electric field produced by the electrode device, a positive electric field still remains, and thus is still able to pull the toners 12 to be attached onto the recording medium 30.

The electrode device 20 of this invention has a plurality of layers of an electrode layer for establishing electric fields of different magnitudes. The electric fields of different magnitudes pull different amounts of the toners 12 to go through the apertures 22 in the electrode device 20, and then to be attached onto the medium 30, thereby establishing hierarchical levels of print depth. To be more concrete, four preferred embodiments are provided to illustrate the control methodology of the electrode device of this invention.

The 1$^{st}$ Preferred Embodiment

Figure 2A:
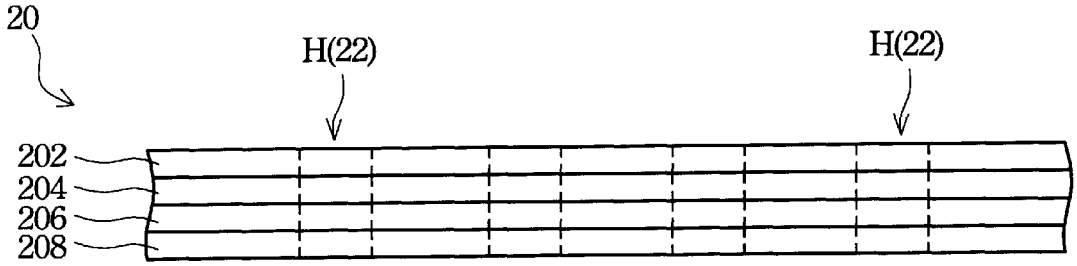
FIG. 2A and FIG. 2B are the profile views and diagrams of the multilayer structure of the electrode device of this invention, respectively.
Figure 2B:
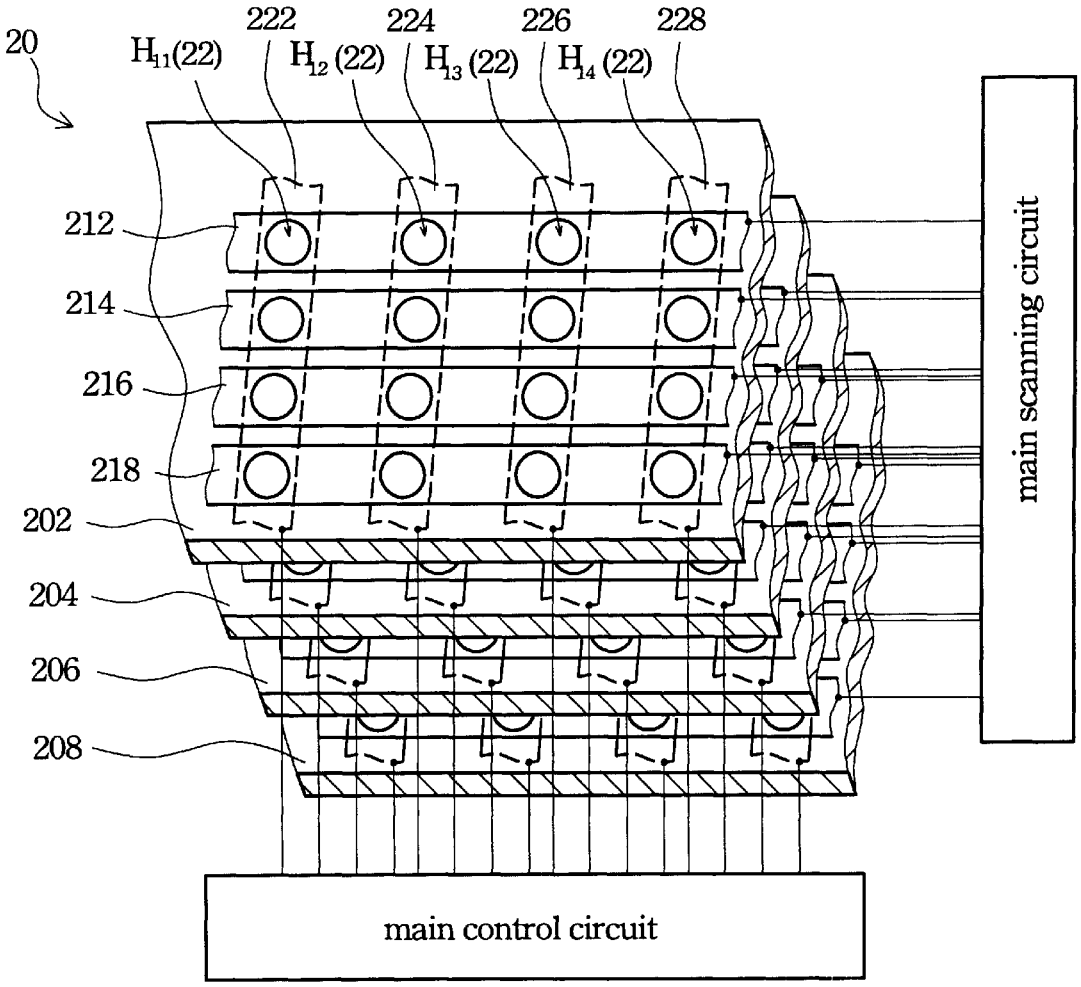

FIGS. 2A and 2B show the profile and diagram of multilayer structure respectively, according to the electrode device of this invention. The electrode device 20 of this invention is composed of n layers of electrode layer, the number of which is determined by the number of levels of the print depth, e.g., from 2 to 100 (but is not limited thereto). For clearly understanding this invention, this preferred embodiment adopts four layers of an electrode layer as an example. The electrode device 20 utilizes electrode layers 202, 204, 206 and 208, and contains at least an aperture 22 passing through the electrode layers 202, 204, 206 and 208. The diameter of the aperture 22 is around tens of microns, or hundreds of microns if the print resolution is not high, and the shape thereof can be a circle, a rectangle or any other. If the number of the aperture is more than one, then the apertures 22 can be aligned in a row or multiple rows, e.g., 4 rows as shown in FIG. 2B.

The electrode layers 202, 204, 206 and 208 are composed of insulating materials and conductive wires, wherein each electrode layer uses insulating material as a substrate and an insulating layer, and the conductive wires needed are formed on the insulating layer and surround at least an aperture 22 that is formed across each electrode layer. This invention is not confined to the arrangement of the wires as long as the wires can surround or partially surround the apertures 22 and are allowed to be applied with a voltage. This invention uses mesh wires as an example to illustrate the preferred embodiment.

As shown in FIG. 2B, every electrode layer has parallel scanning-axis electrodes 212, 214, 216 and 218, connected to a main scanning circuit, respectively; and control-axis electrodes 222, 224, 226 and 228, connected to a main control circuit, respectively. The main scanning circuit and the main control circuit determine whether to apply voltages on the scanning-axis electrodes 212, 214, 216 and 218, and the control-axis electrodes 222, 224, 226 and 228. A scanning-axis electrode crosses with a control-axis electrode without contact in the aperture 22, both of which can be either perpendicular or arranged at any other angle. For example, the scanning-axis electrode 212 and the control-axis electrode 222 cross in the aperture $H_{11}$(22), on which whether to apply voltage is determined and controlled by the scanning-axis electrode 212 and control-axis electrode 222 on the electrode 202. Whether each electrode layer 202, 204, 206 or 208 has applied a voltage on the aperture $H^{11}$ determines the total voltage amount imposed, and thus the magnitude of electric field can be determined. In this preferred embodiment, the voltage is equally provided from each electrode layer. For example, each electrode layer 202, 204, 206 or 208 provides 50V, and thus the total voltage value provided is up to 200V. Besides, a base electrode layer (not shown) can be added for adjusting the initial voltage. For example, the base electrode layer provides 200V, and together with the voltages from the other 4 electrode layers, the total voltage amount is from 200V to 400V. Alternatively, the substrate of electrode layer can be removed, and then the first layer can be adjusted to be 250V. After the other 3 electrode layers are incorporated, consequently, the total voltage amount ranges from 250V to 400V.

If the electrode device 20 has n layers of electrode layer, each of which can determine whether to apply a voltage on the aperture $H_{11}$, then the electric field intensity of the aperture $H_{11}$ has (n+1) different levels, i.e., from level 0 to level n, and thus those (n+1) different levels of electric field intensity are established in the aperture $H_{11}$ to provide (n+1) levels of print depth. When the depth of the mth level (the depth level ranges from 0 to n) needs printing, voltages are applied on a total of m layers of electrode layer, so that the electric field intensity of the mth level is established, whereby toners 12 are driven to pass through the aperture 22 and to be attached onto the recording medium for forming the mth level of print depth.

Figure 3:
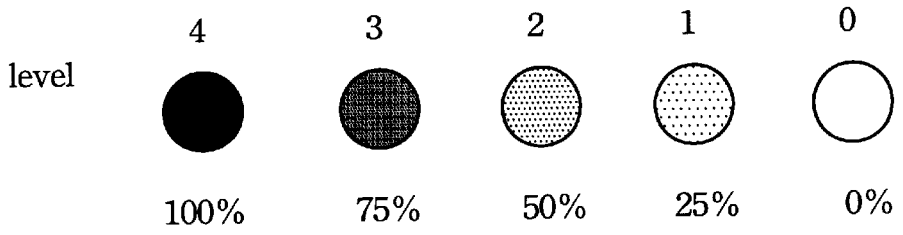
FIG. 3 is the diagram illustrating a preferred embodiment of the electrode device of this invention, showing the density ratios of print depth with four layers of electrode layer.

In the following, the structure of 4 electrode layers is taken as an example. The aperture $H_{11}$ is applied with the voltage having 5 different levels (from 0 to 4). With no voltage applied, no toner 12 passes, and the print depth is level, 0, so that no dot is printed. When one of the electrode layers is applied with the voltage, some toners pass through the aperture $H_{11}$, forming level 1 of print depth. When two of the electrode layers are applied with the voltage, double amount of toners pass through the aperture, forming level 2 of print depth. Likewise, level 3 and level 4 can also be formed. FIG. 3 illustrates the density ratios of print depth printed with a single print dot from the electrode device of this invention under the situation of using 4 electrode layers. The density ratios of print depth can be such as 0%, 25%, 50%, 75%, and 100%. The more number of layers in the electrode device 20 have been applied with the voltage, the darker the level of print depth is.

Figure 4:
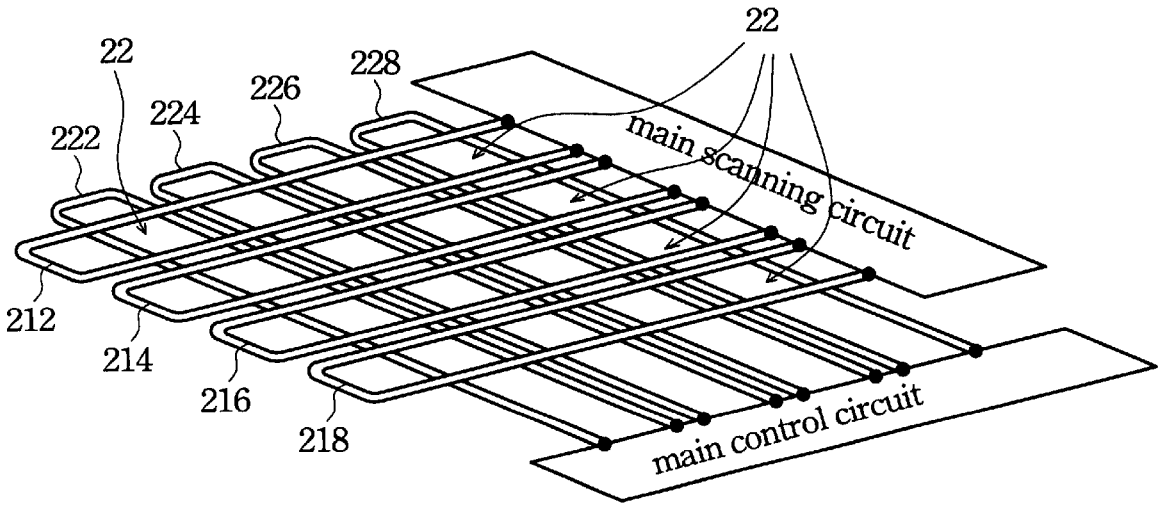
FIG. 4 is the diagram of conductive wires of the electrode device.
Figure 5A:
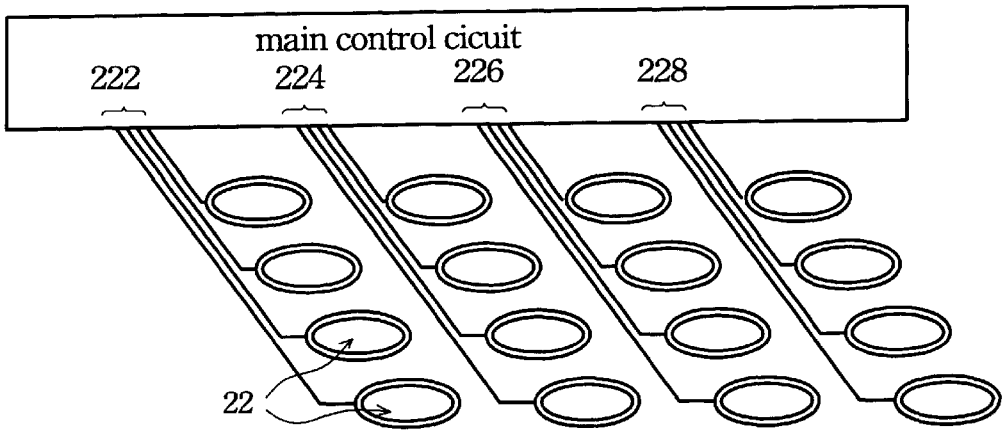
FIG. 5A and FIG. 5B are the diagrams of conductive wires of the electrode device.
Figure 5B:
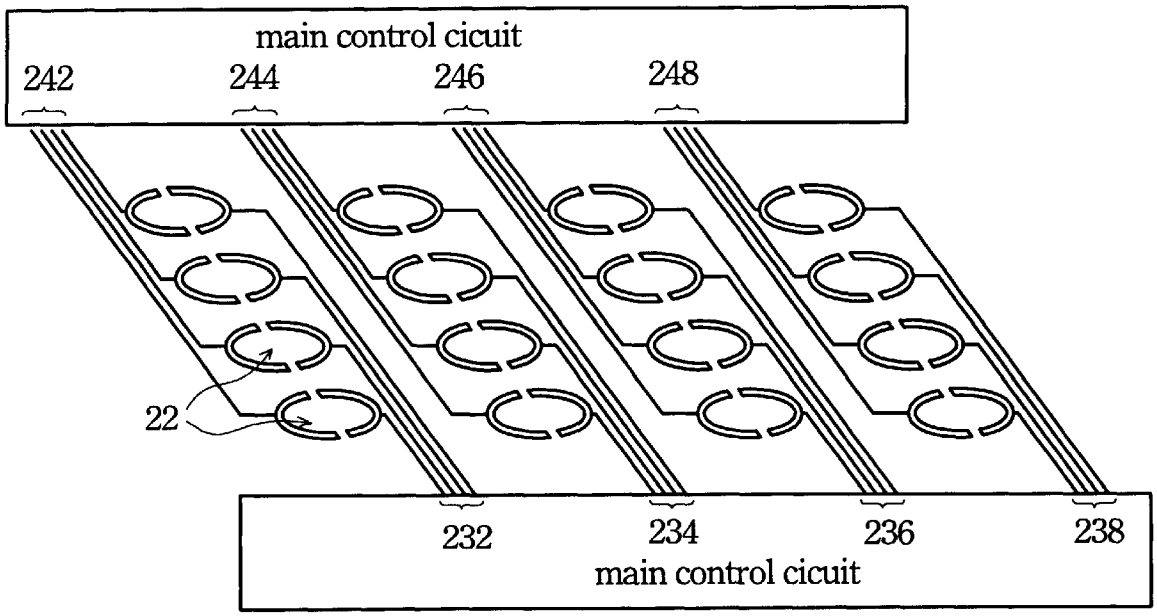

FIGS. 4, 5A and 5B show other types of electrode wire arrangements on the electrode device. Please refer to FIG. 4, wherein wires can be used to surround apertures 22. When the number of the apertures 22 is limited, the apertures 22 can be directly surrounded using the control-axis electrodes 222, 224, 226, and 228 connected to a main control circuit, such as shown in FIG. 5A; or partially surrounded using the control-axis electrodes 232, 234, 236, 238, 242, 244, 246, and 248 connected to the main control circuit, such as shown in FIG. 5B.

In the following, the control methodology of the electrode device of this invention is introduced. Please refer to FIG. 1, FIG. 2A and FIG. 2B. The cartridge device 10 provides charged colorant particles, such as, toners 12. While reaching near the electrode device 20, the toners 12 with negative charge are attracted by the electric field established by the electrode layers of the electrode device 20, and jump across the aperture 22, wherein the electrode layer has been applied with a voltage. The amount of toners passing through the aperture 22 is directly proportional to the voltage. For example, in dual axis electrode, while intending to print the mth level of print depth on the aperture $H_{11}$ in n layers of electrode layer, the apparatus applies a voltage on the scanning-axis electrode 212 of electrode layers as well as on the control-axis electrode, thereby establishing an electric field needed for printing the mth level of print depth, and pulling the amount of toners of the mth level of print depth to pass through the aperture $H_{11}$. The toners 12 across the aperture $H_{11}$, are then attracted by the electric field established by the high voltage generated from a back electrode device 40, and are attached onto the recording medium 30. In general, the cartridge device 10 and the back electrode device 40 have the voltage difference of about 1000–2500V. By using the structure shown in FIG. 5A and FIG. 5B or other similar structures, the voltage can be directly applied on the control-axis electrodes of m layers of electrode layer, since no scanning-axis electrode exists.

While printing, the device can apply the method of interval printing, in order to avoid interference between two neighboring print dots. For example, with the use of horizontal interval, the apertures $H_{11}$ and $H_{13}$ are first to print, and the apertures $H_{12}$ and $H_{14}$ are preceded afterwards for avoiding the interference with neighboring aperture(s). Besides, printing can also be done from the apertures that are more than one aperture interval apart, thereby shortening the distance between apertures and increasing print resolution.

Figure 6:
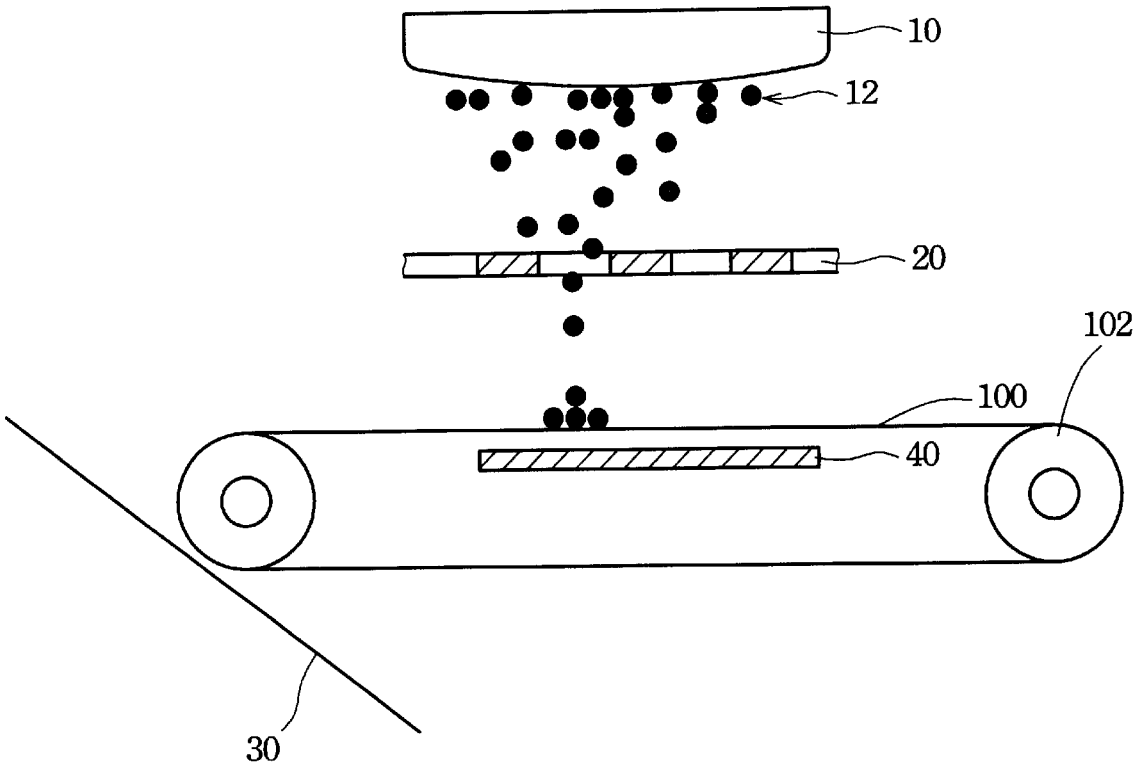
FIG. 6 illustrates the intermediate on which toners are attached and then transferred to recording media.

Please refer to FIG. 6, wherein the control methodology of the electrode device of this invention can also be applied to other types of electrostatic printing apparatuses. For example, after the toners 12 pass through the apertures in the electrode layers, instead of being directly deposited on the recording medium, they are attached onto an intermediate, such as a printing tape 100 or a roller. Then, the printing tape 100 is moved by the rolling pivot to contact the recording medium 30, thereby transferring the toners 12 to the recording medium 30. The intermediate is usually made of non-metal, such as plastic or rubber.

The manufacturing method of the electrode device of this invention is described as follows. There are many kinds of manufacturing methods that exist today. As long as the manufacturing methods are applicable for manufacturing the structure of this invention, they are considered falling within the scope of this invention. Therefore, this invention provides several manufacturing methods of the electrode device.

Figure 7A:
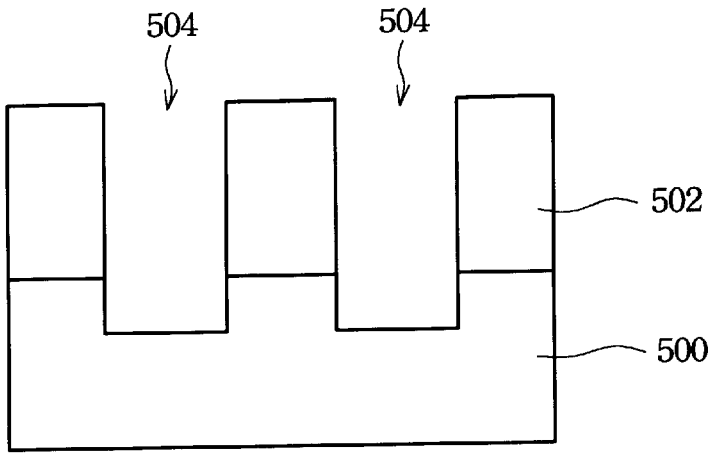
FIG. 7A to FIG. 7C illustrate another manufacturing method of the electrode device of this invention.
Figure 7B:
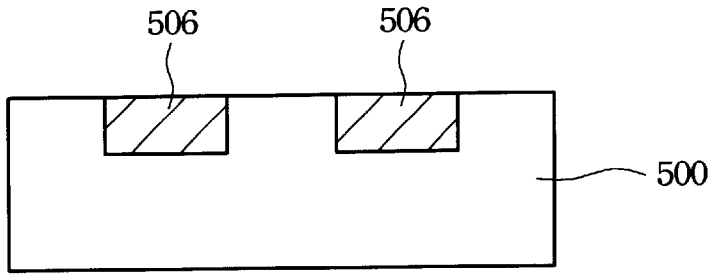
Figure 7C:
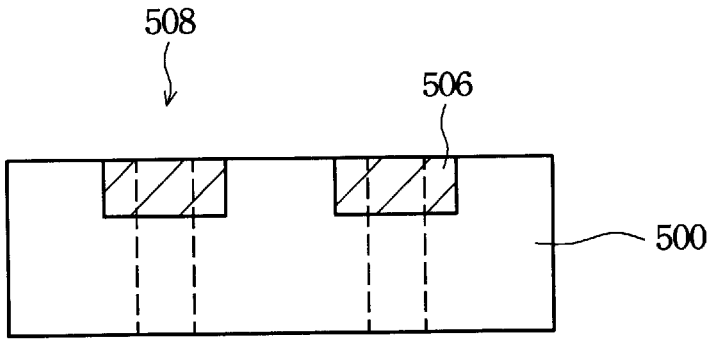

Please refer to FIG. 7A. The electrode device is first provided with a non-metallic substrate 500 on which a photoresist layer 502 is spread. Then, photolithography and etching are undertaken separately, and a portion of the substrate 50 is removed to form the required channel 504 for the formation of conductive wires, and then the photoresist layer 502 is removed. Please refer to FIG. 7B for the following steps. By electroforming, evaporating, or sputtering, the metal of conductive wires 506 is distributed on the channel 504. Thereafter, a protection layer (not shown) can be optionally coated on the substrate 500. Then, as shown in FIG. 7C, the aperture 508 is manufactured using high-speed particles or ions, or fluid blasting, and the manufacturing method thereof can also be laser drilling, etching, or mechanical punching. Then the electrode layer for one-axis conductive wire is formed. If the electrode layer for dual-axis conductive wire is desired, the aforementioned steps have to repeat once again to form the other half-layer for the second-axis conductive wire, and these two half-layers are affixed together. Finally, n layers of electrode layers are affixed together to be a n-electrode-layer structure. Or, after the manufacture of each electrode layer (or half-layer) is completed with the steps as shown above, all layers (or half-layers) of electrode layer are affixed together, and then the aperture is produced for finally forming an n-electrode-layer structure.

Figure 8A:
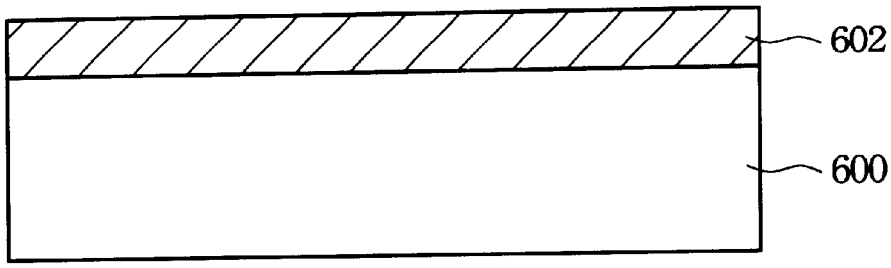
FIG. 8A to FIG. 8C illustrate another manufacturing method of the electrode device of this invention.
Figure 8B:
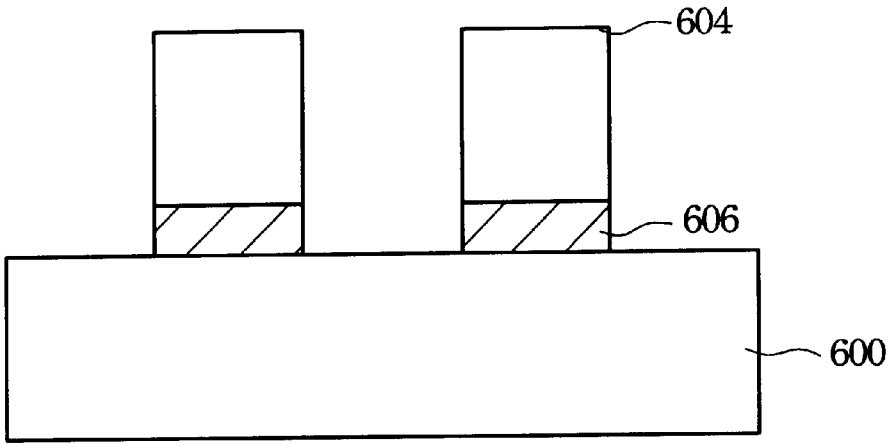
Figure 8C:
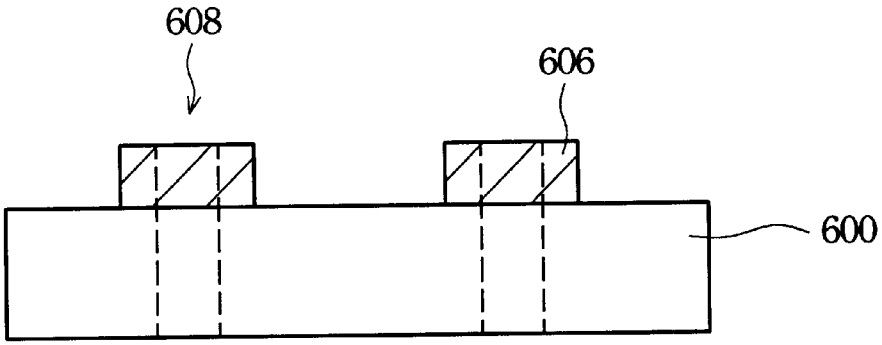

Please refer to FIG. 8A to FIG. 8C, wherein this invention also provides a manufacturing method of an n electrode layer. Referring specifically to FIG. 8A, the electrode device is first provided with a non-metallic substrate 600 on which a metal layer 602 is formed, the methods of which can be hot plating or gluing the metallic layer to the substrate 600, or by electroforming, evaporating, or sputtering to form the metallic layer on the substrate 600. Then, a photoresist layer 604 is coated to cover the metallic layer 602, and then photolithography and etching are undertaken separately to remove unnecessary portions of the metallic layer 602 with while leaving the necessary conductive wires 606. Thereafter, a photoresist layer 604 is removed, and a layer of electrode protection layer (not shown) is optionally distributed on the entire substrate 600. Then, please refer to FIG. 8C, wherein the aperture 608 is manufactured using high-speed particles or ions, or fluid blasting. The method for manufacturing the aperture 608 can also be laser drilling, etching, or mechanical punching. Then the electrode layer for one-axis conductive wire is done. If the electrode layer for dual-axis conductive wire is desired, the aforementioned steps have to be repeated once again to form the other half-layer for the second-axis conductive wire, and these two half-layers are affixed together. Finally, n layers of electrode layer are affixed together to be a nelectrode-layer structure. Or, after the manufacture of each electrode layer (or half-layer) is completed with the steps as shown above, all layers (or half-layers) of the electrode layer are affixed together, and then the aperture is produced for finally forming an n-electrode-layer structure.

Figure 9A:
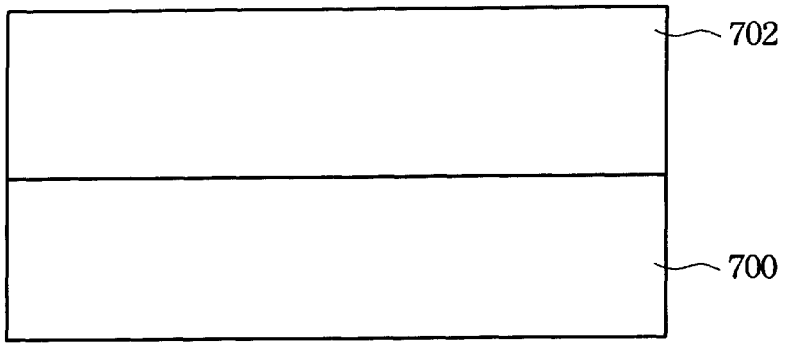
FIG. 9A to FIG. 9D illustrate another manufacturing method of the electrode device of this invention.
Figure 9B:
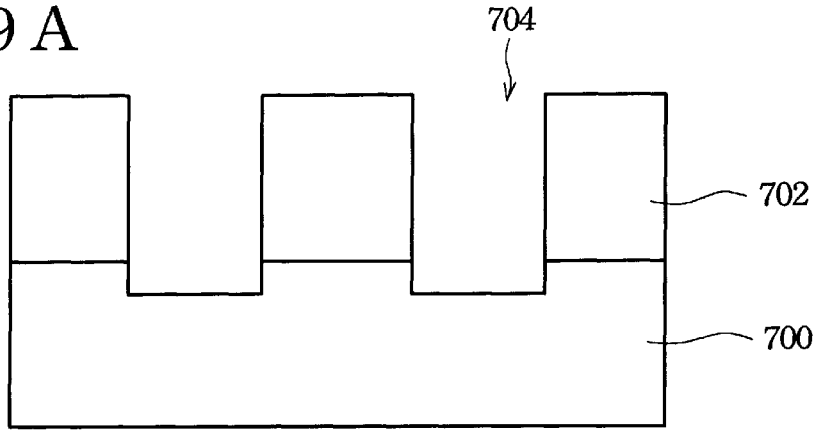
Figure 9C:
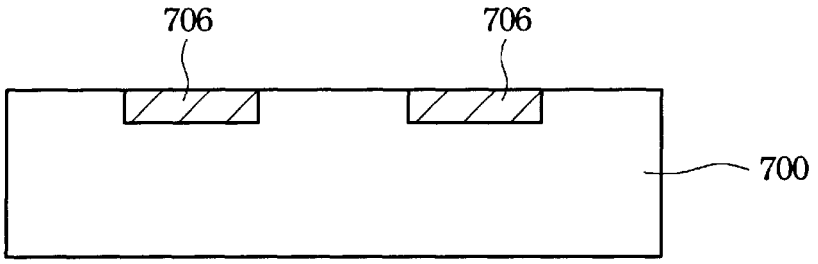
Figure 9D:
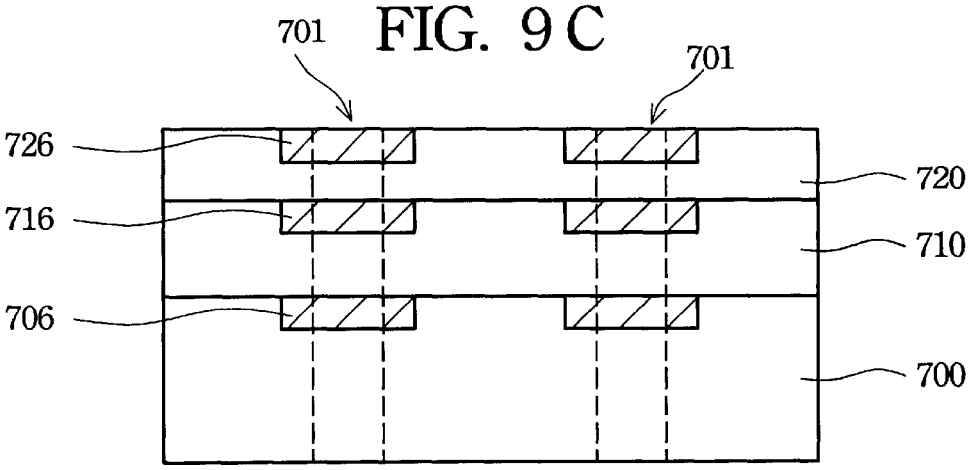

Please refer to FIG. 9A to FIG. 9D, wherein this invention provides another manufacturing method of an n electrode layer. Referring specifically to FIG. 9A, the electrode device is first provided with a non-metallic substrate 700 on which a photoresist layer 702 is spread. Then, and referring to FIG. 9B, photolithography and etching are undertaken separately to remove a portion of the substrate 700 for forming channel 704, and then a photoresist layer 702 is removed. Please refer to FIG. 9C, wherein the metal of conductive wire 706 is distributed via electroforming, evaporating or sputtering. Please refer to FIG. 9D, wherein an insulation layer 710 is distributed on the substrate 700. Then the electrode layer for one-axis conductive wire is done. If the electrode layer for dual-axis conductive wire is desired, the aforementioned steps have to be repeated once again to form the other half-layer for the second-axis conductive wire. Thereafter, by the method illustrated above, a second electrode layer is repetitively manufactured until the n-electrode-layer structure is completed. Then, the n electrode layer can be optionally covered with an electrode protection layer. At last, via high-speed particles or ions, or fluid blasting, the apertures 701 are formed. The manufacturing of apertures can also be accomplished by laser drilling, etching, or mechanical punching so as to complete the n-electrode-layer structure.

Figure 10A:
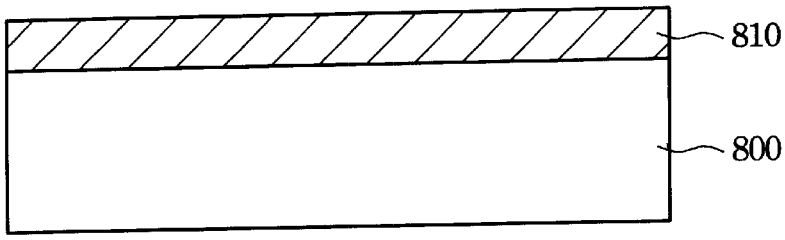
FIG. 10A to FIG. 10D illustrate another manufacturing method of the electrode device of this invention.
Figure 10B:
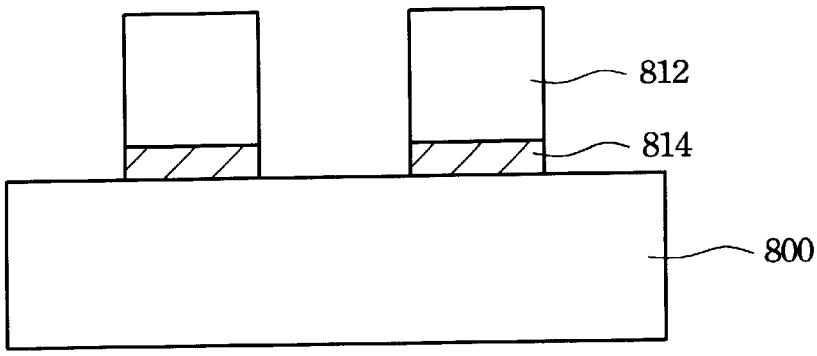
Figure 10C:
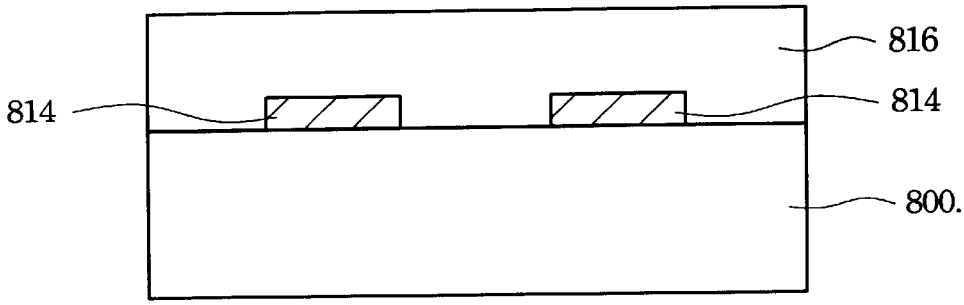
Figure 10D:
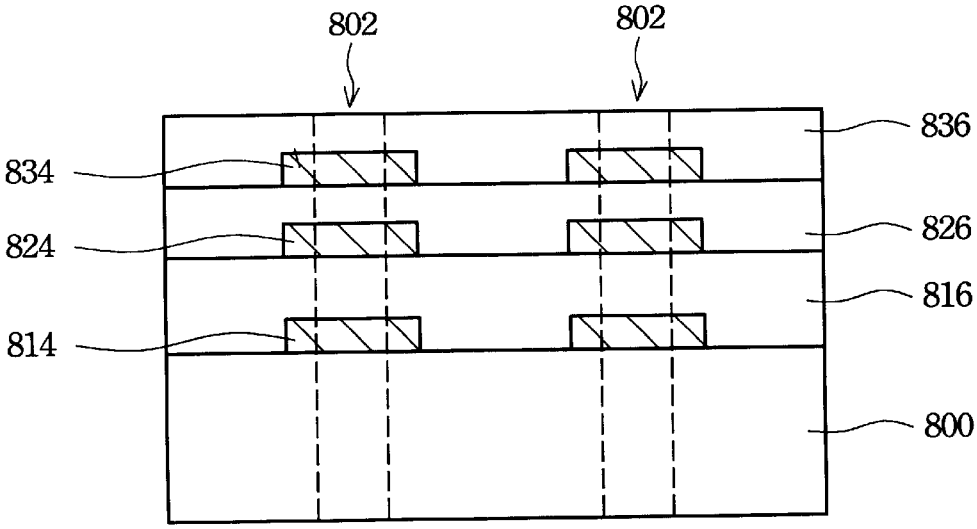

Please refer to FIG. 10A to FIG. 10D, wherein this invention provides another manufacturing method of an n electrode layer. Referring specifically to FIG. 10A, the electrode device is first provided with a non-metallic substrate 800, and by facilitating electroforming, evaporating or sputtering, a metal layer 810 is formed, over which a photoresist layer 812 is spread. Referring specifically to FIG. 10B, photolithography and etching are then undertaken separately to remove a portion of the substrate 810 while leaving remaining necessary conductive wire 814, and then a photoresist layer 812 is removed. Please refer to FIG. 10C, wherein an insulation layer 816 is distributed over the entire substrate 800. Then the electrode layer for one-axis conductive wire is formed. If the electrode layer for a dual-axis conductive wire is desired, the aforementioned steps have to be repeated once again to form the other half-layer for the second-axis conductive wire. Thereafter, and referring to FIG. 10D, the method illustrated above is used to repetitively manufacture each electrode layer until an n-electrode-layer structure is formed. Thereafter, the n electrode layer can be optionally covered with an electrode protection layer. Then, via high-speed particles, ions or fluid blasting, the apertures 802 are formed. The manufacturing of apertures can also utilize the method of laser drilling, etching, or mechanical punching so as to complete the n-electrode-layer structure.

Another application and implementation of this invention is to combine both the methods in FIG. 9 and FIG. 10. A portion of the manufacture of conductive wire is formed by firstly forming a metallic layer; then performing photo-lithography; and etching, and the rest of the conductive wires are made by firstly covering with a photoresist; then performing photo-lithography; etching; and then filling the channel with metal.

The $2^{nd}$ Preferred Embodiment

The structure of the electrode device described herein is the same as the one in the first preferred embodiment, but the control methodology is slightly different.

Figure 11:
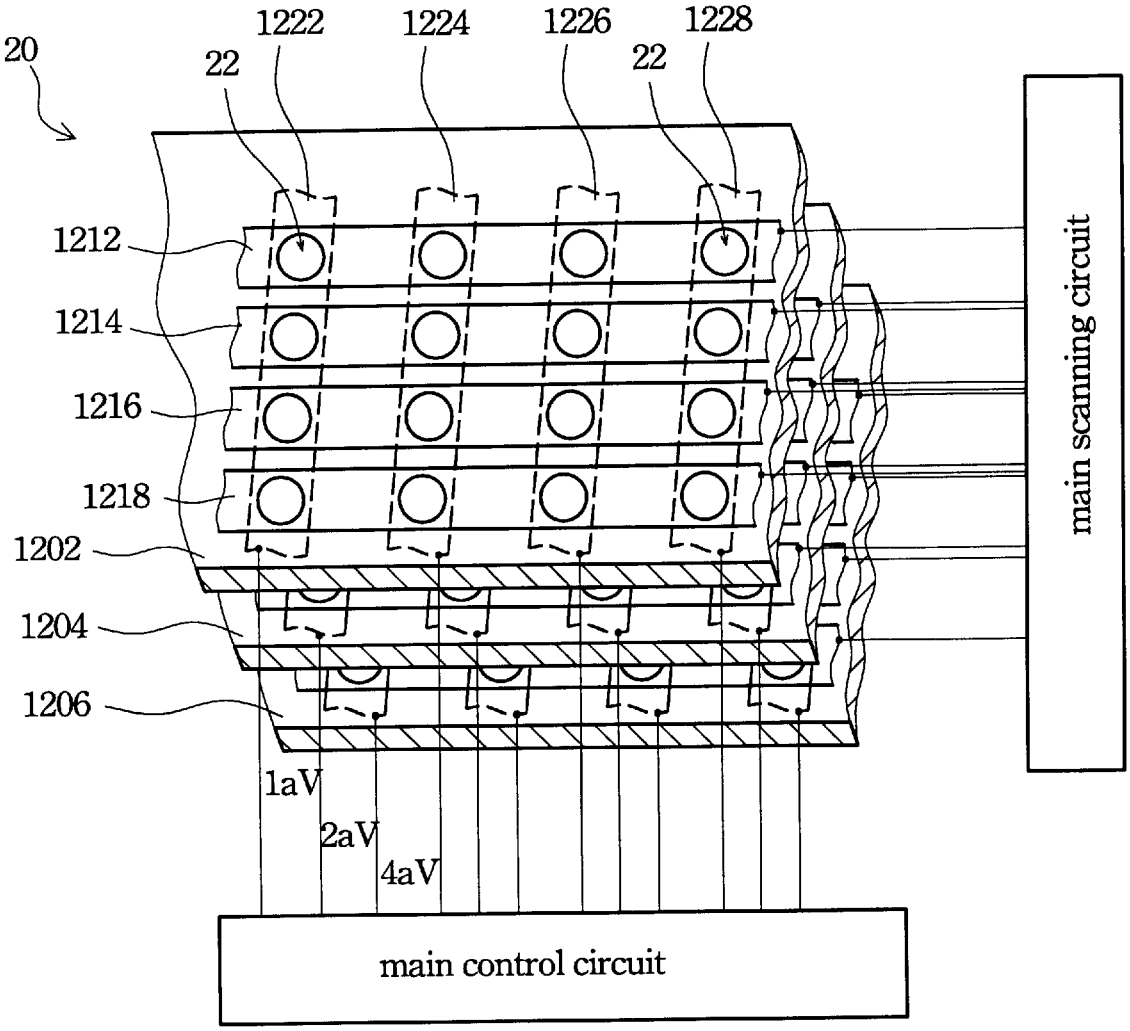
FIG. 11 illustrates a diagram of another preferred embodiment of the structure of the electrode device, wherein the voltage used is a binary composition.

As shown in FIG. 11, every electrode layer has parallel scanning-axis electrodes 1212, 1214, 1216, and 1218, and the control-axis electrodes 1222, 1224, 1226, and 1228. The scanning-axis electrodes 1212, 1214, 1216, and 1218 are connected to the main scanning circuit, respectively. The control-axis electrodes 1222, 1224, 1226, and 1228 are connected to the main control circuit through conductive wires, respectively. By means of the main scanning circuit and main control circuit, it is determined whether to apply voltage to the scanning-axis electrode 1212, 1214, 1216, and 1218, and to the control-axis electrodes 1222, 1224, 1226, and 1228. A scanning-axis electrode and a control-axis electrode cross each other without contact in the aperture 22 with a vertical angle or other angles. Whether to apply voltage on the aperture 22 by each electrode layer 1202, 1204 or 1206 determines the total voltage amount on the aperture 22 and the magnitude of electric field imposed through the scanning-axis electrodes and control-axis electrodes of each electrode layer. As mentioned already, the wire arrangement is not limited to the pattern shown in the figure.

In this preferred embodiment, the voltage intensity values on the electrode layers 1202, 1204 and 1206 are different, wherein the value is doubled one by one. For example, the electrode layer 1202 is applied with the voltage 1 aV; the electrode layer 1204 with 2 aV; the electrode layer 1206 with 4 aV; and the same step proceeds up to the nth electrode layer, the voltage applied reaches $2^{n-1}$ aV. For example, the electrode layer 1202 is applied with the voltage 20V; the electrode layer 1204 with 40V; the electrode layer 1206 with 80V; and the same step proceeds and finally a binary composition of voltage is formed. Controlling the on and off of each electrode layer can compose a binary logic composition of voltage.

If the electrode 20 contains n layers of electrode layer, generally from 2 to 15 layers (but not limited thereto), each electrode layer enables to decide whether to apply a voltage on the aperture 22, on which the voltage intensity has $2^n$ different levels, i.e., from level 0 to level $(2^n-1)$. Hence, $2^n$ different levels of electric field can be established in the aperture 22, thereby providing $2^n$ levels of print depth. When there is a need to print the depth of the mth level (the depth level ranging from 0 to $(2^n-1)$), a binary-composed voltage set is applied on n layers of electrode layer, thereby establishing the electric field of the mth level to drive the toners 12 to pass through the aperture 22 and to be attached onto the recording medium for forming the mth level of print depth.

The binary composed voltage is the composition of binary logic. For example, with 3 electrode layers, the voltage intensity applied on the aperture 22 can have 8 different levels (0~7). With no voltage imposed, no toners 12 can pass through the aperture 22, and thus the print depth is level 0, so that no dot is printed. When the electrode layer 1202 goes with 1 aV voltage, and the electrode layers 1204 and 1206 with 0V, the total voltage amount 1 aV leads to the first level of print depth on the print dot. When the electrode layer 1204 is applied with 2 aV voltage, and the electrode layers 1202 and 1206 with 0V, the total voltage amount 2 aV leads to the second level of print depth. When the electrode layers 1202 and 1204 are applied with 1 aV and 2 aV voltage respectively, and the electrode layer 1206 is applied with 0V voltage, the total voltage amount 3 aV leads to the third level of print depth. A similar sequence can be as well applied on the $4^{th}$, $5^{th}$ and $6^{th}$ level of print depth. When the electrode layers 1202, 1204 and 1206 are applied respectively with 1 aV, 2 aV, and 4 aV voltage, the total voltage amount 7 aV leads to the formation of the $7^{th}$ level of print depth.

However, the sequence of increasing voltages is not necessarily related to the sequence of the apertures, e.g., the electrode layer 1202 can be applied with 2 aV, and 1204 with 4 aV, and 1206 with 1 aV. In this preferred embodiment, the electrode layers 1202, 1204 and 1206 are applied respectively with the voltage intensity values, 1 aV, 2 aV and 4 aV.

By controlling the switch of the electrode layers 1202, 1204 and 1206, the voltage of binary logic composition can be achieved, so that the 8 levels of print depth can be formed. The density ratios of print depth can be, for example, 0%, 14.3%, 28.6%, 42.9%, 57.1%, 71.4%, 85.7%, and 100%. The more electrode layers the electrode device 20 has, the darker the print depth is.

As described in the $1^{st}$ preferred embodiment 1, the toners 12 passing through the aperture 22 are attracted by the electric field established by the high voltage derived from the back electrode device 40, and are attached on the recording medium 30. Generally, the voltage difference between the cartridge device 10 and the back electrode device 40 ranges from about 1000 to about 2500V.

The control methodology of the electrode device of this invention can also be applied on the other types of electrostatic printing apparatus. For example, after passing through the apertures in the electrode layers, the toners 12 are attached onto an intermediate, and are then transferred to the recording medium 30. As to the manufacturing method of electrode device, the methods mentioned in the $1^{st}$ preferred embodiment above are also applicable within this $2^{nd}$ preferred embodiment.

The $3^{rd}$ Preferred Embodiment

The structure of the electrode device described herein is the same as the one in the first preferred embodiment, but the control methodology is slightly different from the $1^{st}$ and the $2^{nd}$ preferred embodiments.

Figure 12:
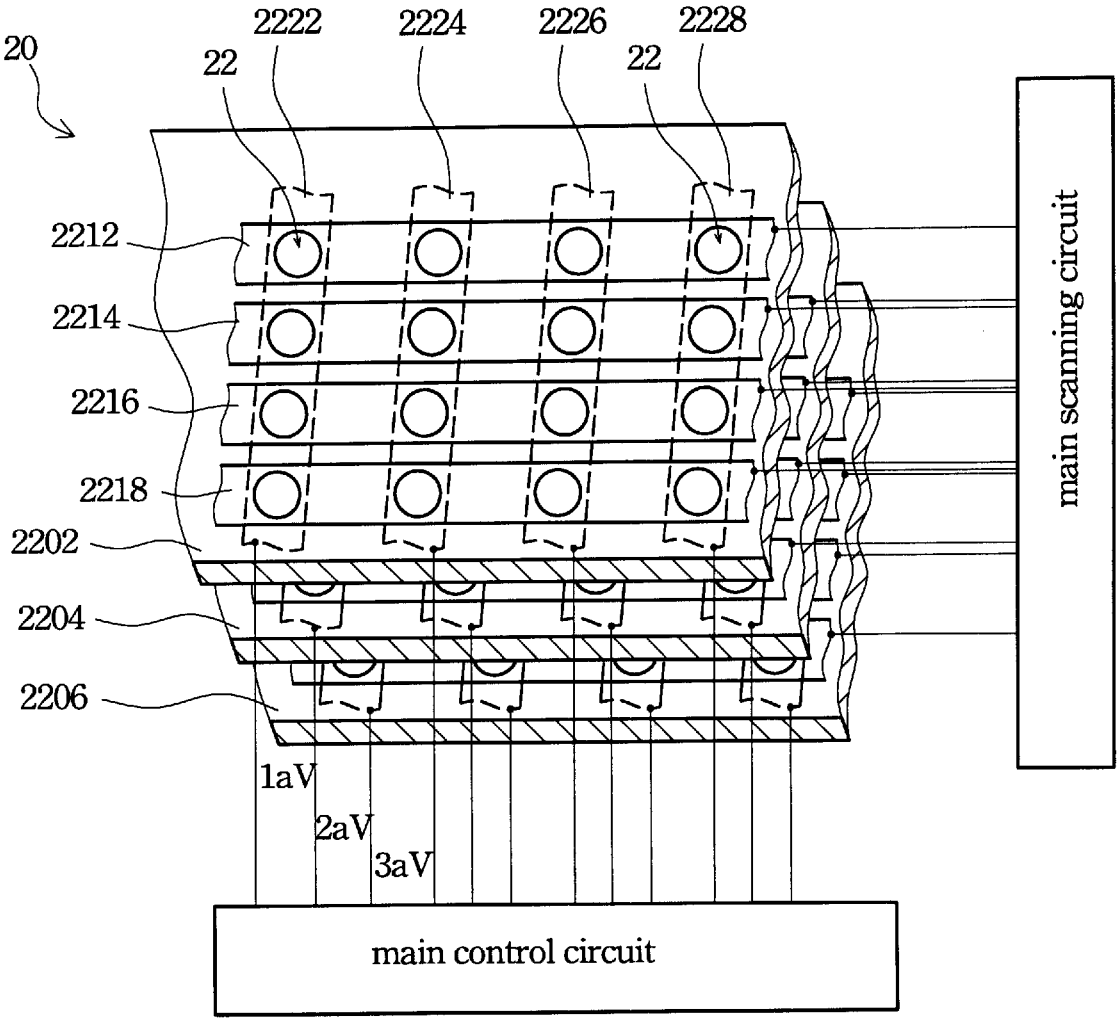
FIG. 12 depicts a diagram of another preferred embodiment of the structure of the electrode device, wherein the voltage used is an arithmetic composition.

As shown in FIG. 12, the electrode hierarchy of each layer has parallel scanning-axis electrodes 2212, 2214, 2216 and 2218, and control-axis electrodes 2222, 2224, 2226, and 2228. The scanning-axis electrodes 2212, 2214, 2216 and 2218 are connected to the main scanning circuit respectively, and the control-axis electrodes 2222, 2224, 2226, and 2228 are connected to the main control circuit respectively. Through the main scanning circuit and the main control circuit, it is determined whether to apply voltages to the scanning-axis electrodes 2212, 2214, 2216 and 2218, and to the control-axis electrodes 2222, 2224, 2226, and 2228. A scanning-axis electrode and a control-axis electrode cross each other without contact in the aperture 22 with a vertical angle or any other angle. Whether to apply a voltage on the aperture 22 from each electrode layer 2202, 2204, 2206 determines the total voltage amount on the aperture 22 as well as the magnitude of electric field imposed through the scanning-axis electrodes and control-axis electrodes of each electrode layer. As mentioned already, the wire arrangement is not limited to the pattern shown in the figure.

In this preferred embodiment, the voltage intensity values of the electrode layers 2202, 2204 or 2206 are different by an arithmetic increment. For example, the electrode layer 2202 is applied with 1 aV voltage; the electrode layer 2204 with 2 aV; the electrode layer 2206 with 3 aV; and the same step proceeds up to the nth electrode layer, on which the voltage applied reaches (n*aV). For example, the electrode 2202 is applied with 50V voltage; and the electrode 2204 with 100V; the electrode 2206 with 150V; and the same step proceeds by imposing the voltages with equal difference. Controlling the "on" and "off" of each electrode layer can acquire an arithmetic composition of voltage.

If electrode device 20 contains n layers of electrode layer, generally from 2 to 50 layers (the scope of this invention is not limited thereto), each electrode layer can determine whether to apply voltage on the aperture 22. The voltage intensity imposed on the aperture 22 has ($\Sigma n+1$) levels ($\Sigma n$ is the total summation of the arithmetic increments, e.g., as n=4, $\Sigma n=4+3+2+1=10$), i.e., from level 0 to level ($\Sigma n$). Hence, an electric field with different ($\Sigma n+1$) levels is established on the aperture 22, i.e., print depth of ($\Sigma n+1$) levels is established. When the mth level (the range of the level of print depth is from 0 to $\Sigma n$) needs printing, an arithmetic-composed voltage is applied on the n electrode layer, thereby establishing the electric field of the mth level to drive the toners 12 to pass through the aperture 22 and to be attached on the recording medium in order.for forming the mth level of print depth.

For example, with 3 electrode layers, the voltage intensity applied on the aperture 22 has 7 different levels (0~6). With no voltage applied, no toners 12 can pass through the aperture 22, and thus the print depth is level 0, so that no dot is printed. When the electrode layer 2202 goes with 1 aV voltage, and the electrode layer 2204 with 0V, and the electrode layer 2206 with 0V, the total voltage amount 1 aV leads to the $1^{st}$ level of print depth. When the electrode layer 2204 goes with 2 aV voltage, and the electrode layers 2202, 2204, 2206 with 0V, the total voltage amount 2 aV leads to the $2^{nd}$ level of print depth. As the electrode layer 2206 goes with 3 aV, and the electrode layers 2202 and 2204 are both with 0V, the total voltage amount 3 aV leads to the $3^{rd}$ level of print depth. When the electrode layers 2202 and 2206 are applied with 1 aV and 3 aV voltage respectively, and the electrode layer 2204 with 0V voltage, the total voltage amount 4 aV leads to the $4^{th}$ level of print depth. In the same way, the $5^{th}$ level can be formed. As the electrode layers 2202, 2204, and 2206 are applied with 1 aV, 2 aV and 3 aV voltage respectively, the total voltage amount 6 aV leads to the $6^{th}$ level of print depth, and the total voltage amount 3 aV can also be established by imposing the voltages 1 aV and 2 aV on 2202 and 2204 respectively.

By utilizing the switches of the electrode layers 2202, 2204, and 2206, the voltage of arithmetic composition can be achieved, thereby marking 7 different levels of print depth. The density ratios of print depth can then be 0%, 16.7%, 33%, 50%, 66.7%, 83% and 100%. As the electrode device 20 uses more layers, the number of levels of print depth is more.

As described in the first preferred embodiment, the toners passing through the aperture 22 are attracted by the electric field established by the high voltage derived from the back electrode device 40, and are attached onto the recording medium 30. Generally, the voltage difference between the cartridge device 10 and the back electrode device ranges from about 1000 to about 2500V.

The control methodology of the electrode device of this invention can also be applied on the other types of electrostatic printing apparatus. For example, after passing through the apertures in the electrode layers, the toners 12 are attached onto an intermediate, and then are transferred to the recording medium 30. As to the manufacturing method of electrode device, the methods mentioned in the $1^{st}$ preferred embodiment above are also applicable in this 3rd preferred embodiment.

The $4^{th}$ Preferred Embodiment

Please refer to the FIG. 12, which is also another preferred embodiment of this invention. The structure of the electrode device is the same as that in the former preferred embodiment, but the voltages applied on the electrode layers 2202, 2204, and 2206 are not regular. For example, the electrode layer 2202 is applied with −100V voltage, and the electrode layer 2204 with −200V, and the electrode layer 2206 with 400V, so that five voltages 0V, 100V, 200V, 300V, and 400V can be shown in the voltage design for representing 5 different levels of print depth, and the density ratios of print depth can be 0%, 25%, 50%, 75%, and 100%. It is noted that two electrode layers are applied with the voltage having the same polarity as the charged particles, so that these two electrode layers can block the charged particles from passing through more effectively.

Similar to the illustration in the $1^{st}$ preferred embodiment, the toners 12 passing through the aperture 22 are attracted by the electric field established by the high voltage created from the back electrode device 40, and are attached onto the recording medium 30. Generally, the voltage difference between the cartridge device 10 and the back electrode device 40 ranges from about 1000 to about 2500V.

The control methodology of the electrode device of this invention can also be applied on the other types of electrostatic printing apparatus. For example, after passing through the apertures in the electrode layers, the toners 12 are attached onto an intermediate, and then are transferred onto the recording medium 30. As to the manufacturing method of electrode device, the methods mentioned in the $1^{st}$ embodiment above are also applicable in this $4^{th}$ preferred embodiment.

From the aforementioned four preferred embodiments, in the $1^{st}$ preferred embodiment, the relationship between the number of levels of print depth k and the number of electrode layers n is $k=n+1$. When any electrode layer is applied with a voltage, the voltage thereon is the same for every electrode layer, which means that the electrode circuit is most symmetrical, and the scanning-axis circuit or control-axis circuit design is most simplified.

In the $2^{nd}$ preferred embodiment, $k=2^n$, wherein the voltage applied on each electrode layer is different, and is doubled consecutively for each electrode layer, thereby reaching the maximum number of voltage combination as well as the levels of print depth.

In the $3^{rd}$ and $4^{th}$ preferred embodiments, the voltages on the electrode layers are not all the same, and may be irregular due to their specific purpose. Actually, there are a lot of similar applications, and these two examples are merely stated for illustration. In practicing the depth-level printing, n layers of electrode layer can provide k-levels of print depth, wherein the range of k is $3 \leqq k \leqq 2^n$, and the range of n is from 2 to 100, and those ranges are included in the preferred embodiments of this invention.

In practicing this invention, a base electrode layer can be added to the electrode layer to adjust the initial voltage of the electrode device, as illustrated in the $1^{st}$ preferred embodiment. Alternatively, a deflection electrode layer can also added to adjust the moving direction of the charged particles, and, with the function of focusing, to make the charged particles move more accurately to the particular position assigned by the recording medium. Or, both of the base electrode layer and deflection electrode layer can be added at the same time.

By changing the parameters of the voltage input on a single electrode layer, such as the waveform or the pulse of voltage, and the time period of voltage imposed, the number of levels of print depth can be more than the original.

In more detail, if the time period of voltage imposed on a single electrode layer can have p different kinds of changes (not including the one at time 0), the level of print depth can be improved from k to q layers, where $q \leqq (p+1)^n$. For example, if the time periods of voltage imposed are 50 $\mu$s, 100 $\mu$s, and 150 $\mu$s, i.e., p=3, then, each electrode layer can have 4 different print levels, thereby making the maximum result representing $4^{th}$ levels of print depth, i.e., $(p+1)^n$. While the most simplified situation is considered, e.g., the $1^{st}$ preferred embodiment, the circuit thereof is parallel, and thus $q \leqq (p+1)^n$.

The control methodology of the electrode device of this invention is provided for the multi-leveled print depth, and can be applied to the different printing resolutions such as 300 dpi, 600 dpi, and 1200 dpi (dot per inch), or even to the higher resolution without reducing the machine resolution. As a result, a high quality print with both high resolution and multi-leveled print depth can be accomplished.

As described above, this invention discloses a control methodology and structure of electrode device of electrostatic printing apparatus. The apparatus provides multi-leveled print depth on recording media without reducing machine resolution, and can be further applied to high-resolution printing.

As is understood by a person skilled in the art, the foregoing preferred embodiments of the present invention are illustrative of the present invention rather than limiting of the present invention. They are intended to cover various modifications and similar arrangements included within the spirit and scope of the appended claims, the scope of which should be accorded the broadest interpretation so as to encompass all such modifications and similar structures.

What is claimed is:

1. A method of controlling a direct electrostatic printing apparatus to provide at least one print dot with multi-leveled print depth, the method of controlling a direct electrostatic printing apparatus comprising:

providing an electrode device constructed by n electrode layers for representing (n+1) levels of a print depth, wherein n is an integer equal to or greater than two, and there is at least one aperture passing through the n electrode layers; and while printing a mth level of the (n+1) levels of the print depth, simultaneously applying a plurality of applied voltages with same magnitude individually to m electrode layers, which are selected from the n electrode layers, for a time period to generate a plurality of electric fields, thereby driving a charged particle passing through the at least one aperture from a cartridge device to be attached onto a recording medium, wherein m is an integer greater than zero, but not greater than n, and the plurality of applied voltages with zero volt are applied to the n electrode layers when m is zero, and the mth level of the print depth is the one selected from level zero to level n.

2. The method of claim 1, wherein a number of the n electrode layers ranges from 2 to 100.

3. The method of claim 1, wherein the charged particle comprises toner.

4. The method of claim 1, wherein the recording medium comprises paper.

5. The method of claim 1, wherein the charged particle passes through the electrode device, and is attached onto an intermediate, and then is transferred to the paper.

6. The method of claim 5, wherein the intermediate comprises rubber.

7. The method of claim 1, wherein a plurality of waveforms of the plurality of applied voltages are changeable.

8. The method of claim 1, wherein the plurality of applied voltages comprising a voltage pulse.

9. The method of claim 1, wherein the time period for applying the plurality of voltages is changeable.

10. The method of claim 9, wherein the time period for applying the plurality of applied voltages has p different types, and the number of the levels of the print depth is improved to q levels, wherein $q<(p+1)^n$.

11. The method of claim 1, wherein the electrode device comprises a base electrode layer to adjust an initial voltage of the electrode device.

12. The method of claim 1, wherein the electrode device comprises a deflection electrode layer to adjust the moving direction and focus of the charged particle.

13. The method of claim 1, wherein the electrode device comprises a base electrode layer and a defection electrode layer.

14. The method of claim 1, wherein the method further comprises a back electrode device to attract the charged particle onto the recording medium.

15. The method of claim 1, wherein each of the n electrode layers has an insulating layer on which a conductive wire is formed, the conductive wire at least surrounding a portion of the at least one aperture.

16. The method of claim 15, wherein the conductive wire comprises a control-axis electrode optionally with a scanning-axis electrode to control one of the plurality of applied voltages applied on the conductive wire.

17. A method of controlling a direct electrostatic printing apparatus to provide at least one print dot with multi-leveled print depth, the method of controlling a direct electrostatic printing apparatus comprising:

providing an electrode device constructed by n electrode layers for representing $2^n$ levels of a print depth, wherein n is an integer equal to or greater than two, and there is at least one aperture passing through the n electrode layers; and while printing a mth level of the $2^n$ levels of the print depth, applying a binary-composed voltage set to the n electrode layers for a time period to generate a plurality of electric fields, thereby driving a charged particle passing through the at least one aperture from a cartridge device to be attached onto a recording medium, wherein m is an integer equal to or greater than zero, but not greater than $(2^n-1)$, and the mth level of the print depth is the one selected from level zero to level $(2^n-1)$.

18. The method of claim 17, wherein a number of the n electrode layers ranges from 2 to 15.

19. The method of claim 17, wherein the binary composed voltage set is a binary logic combination of voltage.

20. The method of claim 17, wherein the charged particle comprises toner.

21. The method of claim 17, wherein the recording medium comprises paper.

22. The method of claim 17, wherein the charged particle passes through the electrode device, and is attached onto an intermediate, and then is transferred to the paper.

23. The method of claim 22, wherein the intermediate comprises rubber.

24. The method of claim 17, wherein a waveform of the binary-composed voltage set applied is changeable.

25. The method of claim 17, wherein the binary-composed voltage set comprises a voltage pulse.

26. The method of claim 17, wherein the time period for applying the binary-composed voltage set is changeable.

27. The method of claim 26, wherein the time period for applying the binary-composed voltage set has p different types, and the number of the levels of the print depth is improved to q levels, wherein $q<(p+1)^n$.

28. The method of claim 17, wherein the electrode device comprises a base electrode layer in order to adjust an initial voltage of the electrode device.

29. The method of claim 17, wherein the electrode device comprises a deflection electrode layer to adjust the moving direction and focus of the charged particle.

30. The method of claim 17, wherein the electrode device comprises a base electrode layer and a deflection electrode layer.

31. The method of claim 17, wherein the method further comprises a back electrode device to attract the charged particle onto the recording medium.

32. The method of claim 17, wherein each of the n electrode layers has an insulating layer on which a conductive wire is formed, the conductive wire at least surrounding a portion of the at least one aperture.

33. The method of claim 32, wherein the conductive wire comprises a control-axis electrode optionally with a scanning-axis electrode to control the binary-composed voltage set applied on the conductive wire.

34. A method of controlling a direct electrostatic printing apparatus to provide at least one print dot with multi-leveled print depth, the method of controlling a direct electrostatic printing apparatus comprising:

providing an electrode device constructed by n electrode layers for representing k levels of a print depth, wherein n is an integer equal to or greater than two, and $3 \leqq k \leqq 2^n$, and there is at least one aperture passing through the n electrode layers; and while printing a mth level of the k levels of the print depth, applying an arithmetic-composed voltage set to the n electrode layers for a time period to generate a plurality of electric fields, thereby driving a charged particle passing through the at least one aperture from a cartridge device to be attached onto a recording medium, wherein m is an integer equal to or greater than zero, but not greater than (k−1), and the mth level of the print depth is the one selected from level zero to level (k−1).

35. The method of claim 34, wherein a number of the n electrode layers ranges from 2 to 50.

36. The method of claim 34, wherein the charged particle comprises toner.

37. The method of claim 34, wherein the recording medium comprises paper.

38. The method of claim 34, wherein the charged particle passes through the electrode device, and is attached onto an intermediate, and then is transferred to the paper.

39. The method of claim 38, wherein the intermediate comprises rubber.

40. The method of claim 34, wherein a waveform of the arithmetic-composed voltage set is changeable.

41. The method of claim 34, wherein the arithmetic-composed voltage set comprises a voltage pulse.

42. The method of claim 34, wherein the time period for applying the arithmetic-composed voltage set is changeable.

43. The method of claim 42, wherein the time period for applying the arithmetic-composed voltage set has p different types, and the number of the levels of the print depth is improved to q level, wherein $q \leqq (p+1)n$.

44. The method of claim 34, wherein the electrode device further comprises a base electrode layer to adjust an initial voltage of the electrode device.

45. The method of claim 34, wherein the electrode device further comprises a deflection electrode layer to adjust the moving direction and focus of the charged particle.

46. The method of claim 34, wherein the electrode device comprises a base electrode layer and a deflection electrode layer.

47. The method of claim 34, wherein further comprises a back electrode device to attract the charged particle onto the recording medium.

48. The method of claim 34, wherein each of the n electrode layers has an insulating layer on which a conductive wire is formed, the conductive wire at least surrounding a part of the at least one aperture.

49. The method of claim 48, wherein the conductive wire comprises a control-axis electrode optionally with a scanning-axis electrode to control the arithmetic-composed voltage set applied on the conductive wire.

50. A method of controlling a direct electrostatic printing apparatus to provide at least one print dot with multi-leveled print depth, the method of controlling a direct electrostatic printing apparatus comprising:

providing an electrode device constructed by n electrode layers for representing (n+1) levels of a print depth, wherein n is an integer equal to or greater than two, and there is at least one aperture passing through the n electrode layers; and while printing a mth level of the (n+1) levels of the print depth, simultaneously applying a plurality of applied voltages with same magnitude individually to m electrode layers, which are selected from the n electrode layers, for a time period to generate a plurality of electric fields, thereby driving a charged particle passing through the at least one aperture from a cartridge device to be attached onto a recording medium, wherein m is an integer greater than zero, but not greater than n, and the plurality of applied voltages with zero volt are applied to the n electrode layers when m is zero, and the mth level of the print depth is the one selected from level zero to level n, and the time period for applying the plurality of applied voltages has p different types, and the number of the levels of the print depth is improved to q levels, wherein $q<(p+1)^n$.

51. The method of claim 50, wherein a number of the n electrode layers ranges from 2 to 100.

52. The method of claim 50, wherein the charged particle comprises toner.

53. The method of claim 50, wherein the recording medium comprises paper.

54. The method of claim 50, wherein the charged particle passes through the electrode device, and is attached onto an intermediate, and then is transferred to the paper.

55. The method of claim 54, wherein the intermediate comprises rubber.

56. The method of claim 50, wherein a plurality of waveforms of the plurality of applied voltages are changeable.

57. The method of claim 50, wherein the plurality of applied voltages comprising a voltage pulse.

58. The method of claim 50, wherein the time period for applying the plurality of voltages is changeable.

59. The method of claim 50, wherein the electrode device comprises a base electrode layer to adjust an initial voltage of the electrode device.

60. The method of claim 50, wherein the electrode device comprises a deflection electrode layer to adjust the moving direction and focus of the changed particle.

61. The method of claim 50, wherein the electrode device comprises a base electrode layer and a deflection electrode layer.

62. The method of claim 50, wherein the method further comprises a back electrode device to attract the charged particle onto the recording medium.

63. The method of claim 50, wherein each of the n electrode layers has an insulating layer on which a conductive wire is formed, the conductive wire at least surrounding a portion of the at least one aperture.

64. The method of claim 63, wherein the conductive wire comprises a control-axis electrode optionally with a scanning-axis electrode to control one of the plurality of applied voltages applied on the conductive wire.

65. A method of controlling a direct electrostatic printing apparatus to provide at least one print dot with multi-leveled print depth, the method of controlling a direct electrostatic printing apparatus comprising:

providing an electrode device constructed by n electrode layers for representing $2^n$ levels of a print depth, wherein n is an integer equal to or greater than two, and there is at least one aperture passing through the n electrode layers; and while printing a mth level of the $2^n$ levels of the print depth, applying a binary-composed voltage set to the n electrode layers for a time period to generate a plurality of electric fields, thereby driving a charged particle passing through the at least one aperture from a cartridge device to be attached onto a recording medium, wherein m is an integer equal to or greater than zero, but not greater than $(2^n-1)$, and the mth level of the print depth is the one selected from level zero to level $(2^n-1)$, and the time period for applying the binary-composed voltage set has p different types, and the number of the levels of the print depth is improved to q levels, wherein $q\leqq(p+1)^n$.

66. The method of claim 65, wherein a number of the n electrode layers ranges from 2 to 15.

67. The method of claim 65, wherein the binary-composed voltage set is a binary logic combination voltage.

68. The method of claim 65, wherein the charged particle comprises toner.

69. The method of claim 65, wherein the recording medium comprises paper.

70. The method of claim 65, wherein the charged particle passes through the electrode device, and is attached onto an intermediate, and then is transferred to the paper.

71. The method of claim 70, wherein the intermediate comprises rubber.

72. The method of claim 65, wherein a waveform of the binary-voltage comprised voltage set applied is changeable.

73. The method of claim 65, wherein the binary-composed voltage set comprises a voltage pulse.

74. The method of claim 65, wherein the time period for applying the binary-composed voltage set is changeable.

75. The method of claim 65, wherein the electrode device comprises a base electrode layer in order to adjust an initial voltage of the electrode device.

76. The method of claim 65, wherein the electrode device comprises a deflection electrode layer to adjust the moving direction and focus of the charged particle.

77. The method of claim 65, wherein the electrode device comprises a base electrode layer and a deflection electrode layer.

78. The method of claim 65, wherein the method further comprises a back electrode device to attract the charged particle onto the recording medium.

79. The method of claim 65, wherein each of the n electrode layers has an insulating layer on which a conductive wire is formed, the conductive wire at least surrounding a portion of the at least one aperture.

80. The method of claim 79, wherein the conductive wire comprises a control-axis electrode optionally with a scanning-axis electrode to control the binary-composed voltage set applied on the conductive wire.

81. A method of controlling a direct electrostatic printing apparatus to provide at least one print dot with multi-leveled print depth, the method of controlling a direct electrostatic printing apparatus comprising:

providing an electrode device constructed by n electrode layers for representing k levels of a print depth, wherein n is an integer equal to or greater than two, and $3 \leqq k \leqq 2^n$, and there is at least one aperture passing through the n electrode layers; and while printing a mth level of the k levels of the print depth, applying an arithmetic-composed voltage set to the n electrode layers for a time period to generate a plurality of electric fields, thereby driving a charged particle passing through the at least one aperture from a cartridge device to be attached onto a recording medium, wherein m is an integer equal to or greater than zero, but not greater than (k−1), and the mth level of the print depth is the one selected from level zero to level (k−1), and the time period for applying the arithmetic-composed voltage set has p different types, and the number of the levels of the print depth is improved to q level, wherein $q \leqq (p+1)^n$.

82. The method of claim 81, wherein a number of the n electrode layers ranges from 2 to 50.

83. The method of claim 81, wherein the charged particle comprises toner.

84. The method of claim 81, wherein the recording medium comprises paper.

85. The method of claim 81, wherein the charged particle passes electrode device, and is attached onto an intermediate, and then is to the paper.

86. The method of claim 85, wherein the intermediate comprises rubber.

87. The method of claim 81, wherein a waveform of the arithmetic-composed voltage set is changeable.

88. The method of claim 81, wherein the arithmetic-composed voltage set comprises a voltage pulse.

89. The method of claim 81, wherein the time period for applying the arithmetic-composed voltage set is changeable.

90. The method of claim 81, wherein the electrode device further comprises a base electrode layer to adjust an initial voltage of the electrode device.

91. The method of claim 81, wherein the electrode device further comprises a deflection electrode layer to adjust the moving direction and focus of the charged particle.

92. The method of claim 81, wherein the electrode device comprises a base electrode layer and a deflection electrode layer.

93. The method of claim 81, wherein further comprises a back electrode device to attract the charged particle onto the recording medium.

94. The method of claim 81, wherein each of the n electrode layers has an insulating layer on which a conductive wire is formed, the conductive wire at least surrounding a part of the at least one aperture.

95. The method of claim 94, wherein the conductive wire comprises a control-axis electrode optionally with a scanning-axis electrode to control the arithmetic-composed voltage set applied on the conductive wire.

* * * * *